United States Patent [19]

Willis et al.

[11] 4,378,894

[45] Apr. 5, 1983

[54] TAMPER-EVIDENT CLOSURE

[75] Inventors: W. Coy Willis, Hagerstown; Leman P. Albrecht, Richmond, both of Ind.

[73] Assignee: Aluminum Company of America, Pittsburgh, Pa.

[21] Appl. No.: 275,306

[22] Filed: Jun. 19, 1981

[51] Int. Cl.[3] ..... B65D 41/34

[52] U.S. Cl. ..... 215/252; 215/250

[58] Field of Search ..... 215/250, 252, 251

[56] References Cited

U.S. PATENT DOCUMENTS

| | | | |
|---|---|---|---|
| 1,670,450 | 5/1928 | Henry | 215/250 |
| 2,124,874 | 7/1938 | Conner et al. | 215/251 |
| 2,131,774 | 10/1938 | Waring | 215/250 |
| 3,695,476 | 10/1972 | Ruekberg . | |
| 4,033,472 | 7/1977 | Aichinger | 215/256 |
| 4,109,815 | 8/1978 | Collins | 215/232 |

*Primary Examiner*—Donald F. Norton

*Attorney, Agent, or Firm*—Max L. Williamson

[57] ABSTRACT

A tamper-evident closure having a central disc end wall panel bonded to a sealing liner and connected to an annular end wall projecting inwardly from the closure skirt wall by at least two fracturable bridges. Removal of a closure of this invention after being applied to a container causes at least one of the bridges to fracture giving evidence that at least an attempt has been made to remove the closure.

5 Claims, 4 Drawing Figures

TAMPER-EVIDENT CLOSURE

BACKGROUND OF THE INVENTION

This invention relates to a closure having a tamper-evident feature.

Closures having a tamper-evident portion for use in sealing containers are known. There are, for example, many types of closures such as that described in Aichinger U.S. Pat. No. 4,033,472 which feature a ring or collar depending from the skirt wall which is attached to the skirt wall of the closure of bridges or a weakened wall section. When the closure is applied to the container, the ring is adapted to engage the container in a manner that when the closure is removed, there is at least a partial separation of the ring from the skirt wall, and thus gives evidence that at least an attempt has been made to remove the closure.

Another type of tamper-evident closure is described in Henry U.S. Pat. No. 1,670,450. Henry describes a closure to be used with a container having a recessed ledge within the mouth of the container. A disc seats snugly upon the ledge to seal the container. To provide evidence of an unscrupulous removal of the disc, a hood having a tamper-evident means therewith is provided on a bead around the mouth of the bottle. A thin diaphragm is bonded to the upper surface of the sealing disc and the diaphragm is attached along its peripheral edge to the hood. To remove the sealing disc, the hood must first be removed and in so doing the thin diaphragm is ruptured giving evidence that at least an attempt has been made to remove the sealing disc.

Many of the tamper-evident closures known heretofore have limited application because of such things, for example, as the cost of making the closure or the need to provide a special container finish suitable for use with the closure.

It is desirable, therefore, to provide a tamper-evident closure that is relatively simple, provides readily observable evidence of tampering with the closure and is adaptable for use with a wide range of containers.

SUMMARY OF THE INVENTION

The present invention is a closure having a skirt wall adapted to engage an open-mouth container. An annular lip extends inwardly from the skirt wall and a central disc end panel is connected to the lip by at least two bridges which are adapted to break when the closure is removed from the container. A liner is bonded to the bottom surface of the central disc panel and the liner has sufficient extent to span the mouth of the container.

Upon application of the closure to the container, the liner is bonded to the upper surface of the container wall surrounding the container mouth. When the closure is rotated to effect removal of the closure from the container, at least one of the bridges is fractured giving evidence that at least an attempt has been made to remove the closure.

An understanding of the invention and its objects and advantages will be more fully appreciated by referring to the following description of a preferred embodiment and accompanying drawings.

DESCRIPTION OF A PREFERRED EMBODIMENT

A preferred embodiment of this invention can be molded from polypropylene or other moldable plastics by plastic molding methods known to one skilled in the art.

Figure 1:
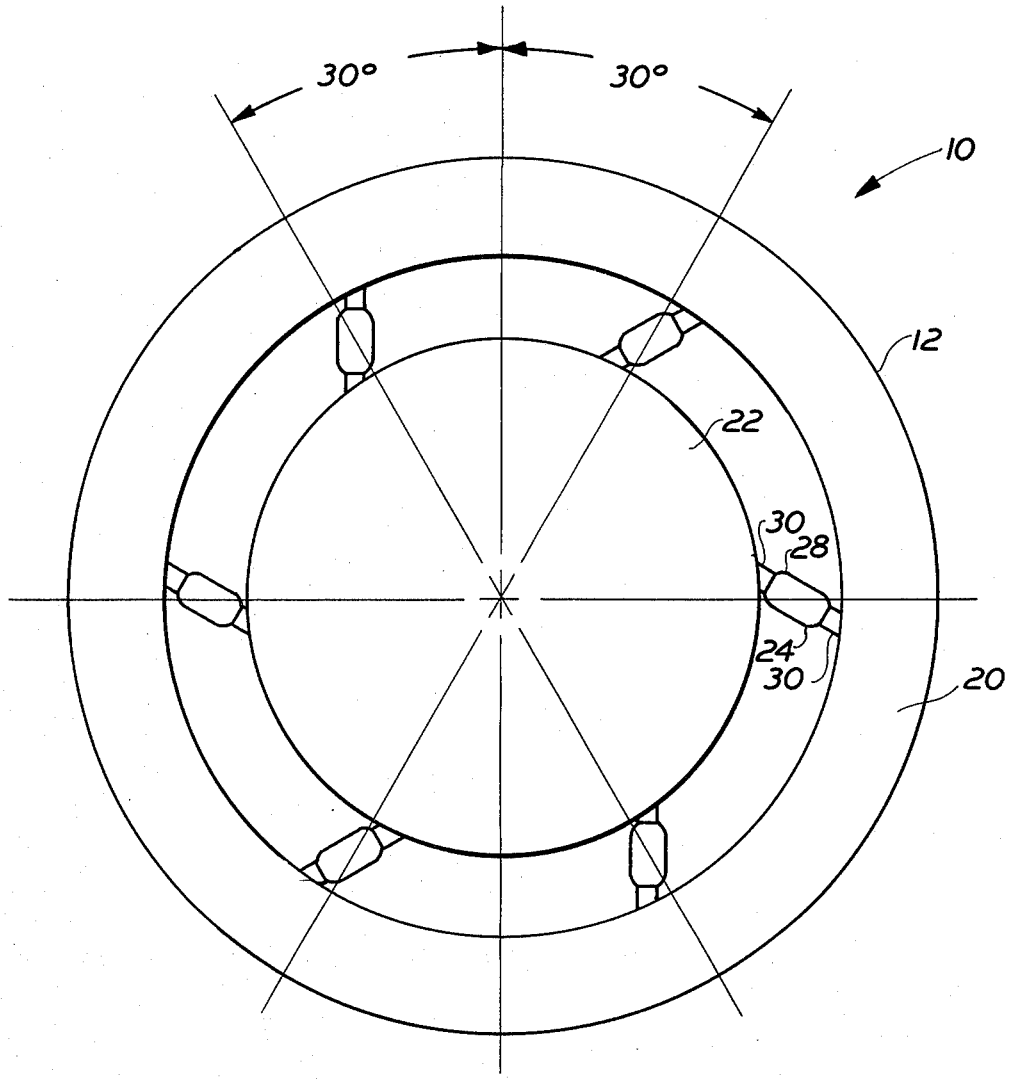
FIG. 1 is a plan view of a closure of this invention.
Figure 2:
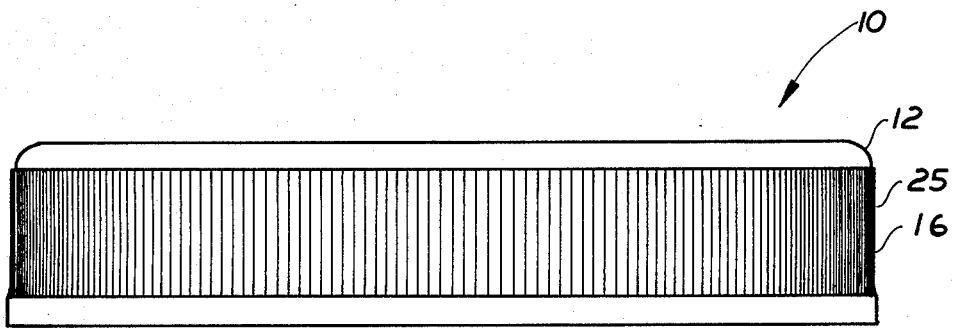
FIG. 2 is an elevation of the closure shown in FIG. 1.
Figure 3:
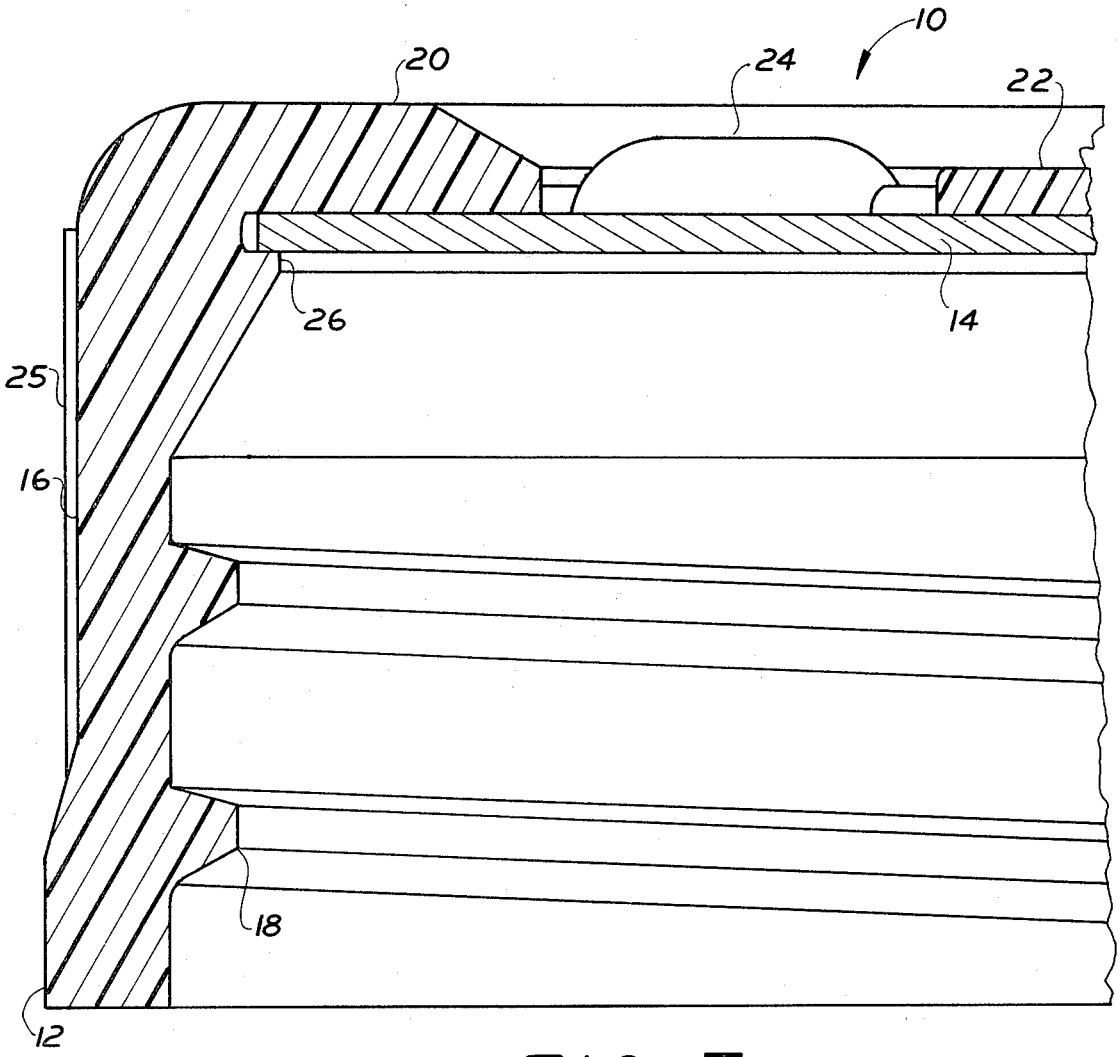
FIG. 3 is a partial cross section of the closure shown in FIG. 2.
Figure 4:
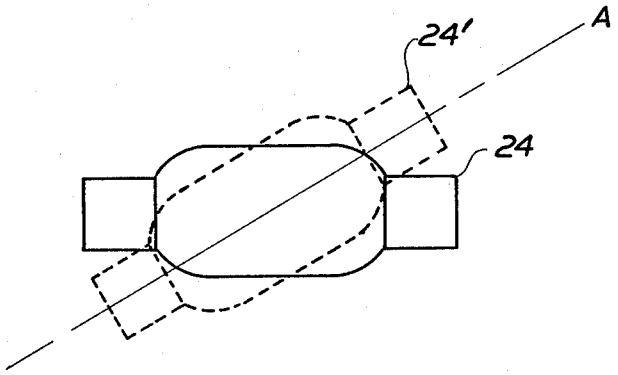
FIG. 4 shows the angular relationship between the axis of a fracturable bridge of the closure and a radial line extending from the axis of the closure through the midpoint of the fracturable bridge.

Referring now to FIGS. 1, 2 and 3, a closure 10 of this invention is comprised of a cap 12 and liner 14. The cap 12 is comprised of a skirt wall 16 having threads 18 thereon to engage with corresponding container threads, a first annular lip 20 projecting inwardly from a top edge of the skirt wall, and a central disc end panel 22 spaced from the first annular lip and connected to the annular lip by a plurality of connecting bridges 24. Knurls 25 are also provided along a portion of the outer surface of the skirt wall 16 for ease in removing the closure. In this preferred embodiment six connecting bridges 24 are shown, but the precise number of bridges required for purposes of this invention may vary depending upon the particular application. It is conceivable that as few as two bridges might be satisfactory to function in this invention, as will be explained later. The bridges 24 are comprised of a central dome-shaped portion 28 having opposing ends joined to the central disc panel 22 and the first annular lip 20 by web portions 30 of lesser cross section than the central domeshaped portion. In this preferred embodiment, the axes of the bridges 24 have an angular disposition in relation to radial lines extending from the center of the closure 10 to the midpoint of each bridge. The disposition of each bridge 24 may best be explained with reference to FIG. 4. A bridge 24' is shown in dashed lines having its axis coaxially aligned with a radial line A extending from the center axis of the closure. By rotating the bridge 24' about its midpoint clockwise approximately 30°, the disposition of each bridge 24 shown in solid lines may be seen. Although disposing the bridges so that their axes are skewed from respective radial lines is of significance, as will be explained later, it is not believed that the extent of the skew is critical to the invention and thus any particular angle selected is largely a matter of choice.

The cap 12 is also provided with a second annular lip 26 projecting inwardly from the skirt wall to retain the liner 14 in the cap. The liner 14 is a circular metal disc suitable for bonding to the container mouth by induction heat sealing; that is, having a thermally responsive adhesive between the bottom surface of the liner and the container wall around the container mouth. Other liners, such as plastic, or composite liners of plastic and metal, for example, may also be suitable for practice of this invention. For purposes of this invention, it is important that the liner be rigid. By rigid is meant having sufficient stiffness to snap in place into the space between the first annular lip 20 and the second annular lip 26 and also having sufficient strength to prevent fracture or deformation of the liner when the closure is removed from a container, as will be explained later. Metal was chosen in this preferred embodiment because the desired method of sealing the liner to the container mouth is by induction heating, but any other suitable method of bonding the liner to the container may be used in the practice of this invention.

The liner 14 is also bonded by any suitable method to the central disc panel 22. It is important to note that the liner 14 is not bonded to any portion of the connecting bridges 24.

Prior to application of the closure, the liner 14 is snapped into the cap 12 and retained therein by the second annular lip 26. The liner 14 is also bonded to the bottom surface of the central panel 22 by a hot melt method or any other suitable method for making an adhesive bond. To apply the closure 10 to a container, the closure is screwed onto the container. The closure-container assembly is subjected to a top pressure as it is then passed through an induction field which provides the heat to melt the adhesive layer on the metal liner 14 to effect a bond between the liner and the container mouth. The use of induction heating to apply closures to containers is known to those skilled in the art. In this preferred embodiment, the bridges 24 are skewed clockwise from a radial line as has previously been described. Thus, when the closure 10 is screwed onto the container in a clockwise direction, the bridges 24 are in tension and the thinner web portions 30 must be of sufficient strength to resist the installation torque.

To remove the closure 10 from the container, the closure is twisted in a counterclockwise direction. The bridges 24 now are in compression and the effect of the compressive stress is to cause the bridges to twist or rotate about their longitudinal axes and cause one or the other of the connecting portions 30 in at least one bridge to break. Typically all or a majority of the bridges will break when the closure is torqued in removing it from the container, but even the breaking of one bridge 24 would give an indication of an attempt to tamper with the closure-container assembly. Breaking of the bridges 24 occurs because the skirt wall 16 is not bonded to the liner 14. The closure 10 can be rotated approximately 45° before the retaining lip 26 lifts the liner 14 and breaks the seal between the liner and the container. Since the skirt wall 16 rotates relative to the liner 14 during the initial application of torque in unscrewing the closure 10, the bridges 24 are immediately stressed because of the adhesive bond between the liner 14 and the central panel 22 of the cap 12, and at least one of the bridges 24, and more typically all or a majority of the bridges 24, will fracture before the seal between the liner and container is broken. It is apparent that the strength of the liner 14 must be sufficient to avoid fracture or deformation of the liner and that the shear strength of the bond between the liner and the central panel 22 is sufficient to prevent separation between the liner and central panel when the closure is removed from the container. Further rotation of the closure causes the retaining lip 26 to lift the liner 14, break the seal between the liner and the container and removal of the closure. The closure can be reapplied and obtain a compressive seal between the liner and container since the liner is retained in the closure by annular lip 26.

If desired, a closure of this invention may be used in an application wherein the liner 14 remains affixed to the container when the cap 12 is removed. In such an embodiment, the second annular lip 26 is deleted and the liner 14 is attached to and retained on the cap 12 by an adhesive bond between the liner and the central disc panel 22.

The closure 10 is applied to the container and the liner 14 sealed thereon in the same manner as was described for the preferred embodiment. By insuring that the bond between the liner 14 and the container and the bond between the liner and central disc panel 22 exceed the fracture strength of the bridges 24, the cap 12 can be removed without separating the liner from the container. It may be seen that as the cap 12 is rotated for removal the central disc panel 22 is restrained from rotation by the bond with the liner which causes the bridges 24 to fracture and thus provides evidence that at least an attempt was made to remove the closure.

Since the tamper-evident feature of this closure is on the top of the closure, any attempt to remove the closure from the container is readily noticeable.

Although the preferred embodiment has been described as having bridges comprised of a dome-shaped central body 28 and connecting portions 30 of a lesser cross section, it is apparent that this invention can be practiced with bridges of other configurations. To be within the scope of this invention, it is only required that the bridges 24 have at least a portion which will fracture from the application of removal torque to the closure prior to breaking the seal between the liner and the container.

It is further apparent that the bridges 24 need not be skewed from a closure radial line as has been previously described, although this is preferred. The bridges 24 can have their axes in coaxial alignment with respective radial lines, but greater care must be exercised in applying the closure to the container to insure that the bridges are not fractured when screwing the closure onto the container.

There are applications of a closure of this invention in which it is advantageous to skew the axes of the bridges 24 in a counterclockwise direction from respective radial lines. In one method of packaging materials in a container, for example, a vacuum is created within the container which draws the closure having the liner 14 therein tightly against the container mouth and the liner is then sealed thereon. In applying a closure in this manner, the bridges 24 are not stressed since no torque is involved in assembling and sealing the closure on the container. In one method of removing a closure applied by a vacuum process, the closure is torqued in a counterclockwise direction in the same fashion as if it were a conventionally threaded assembly. With the bridges 24 skewed in a counterclockwise direction, the bridges are immediately placed in tension and adapted so as to cause at least one bridge to fracture before the seal between the liner 14 and the container is broken. The advantage in having the bridges 24 in tension at the time they are broken is that their breaking produces a pronounced sound and thus there is provided not only a visual indication of tampering but an audible signal as well. It is believed that the snapping sound produced by a bridge 24 breaking in tension is amplified by resonance of the liner 14.

What is claimed is:

1. A tamper-evident closure assembly for engaging and closing the open mouth of a container by rotation of the closure with respect to the container and comprising:

a cap portion having a skirt wall including means thereon for engaging closure retaining means on the outer surface of a container mouth and an integral portion located centrally of the top of said skirt wall and connected thereto by frangible bridge means;

a rigid disc liner underlying said integral portion and affixed thereto, said liner having sufficient radial extent for disposition of an outer edge portion thereof against a container wall around the container mouth and being adapted to seal the same against the container mouth to an extent sufficient to prevent separation of the seal during at least a first portion of rotational movement of the closure in effecting a disengagement of the closure from the container and thereby said liner and said integral portion are restrained from being rotated with the closure during at least a first portion of removal of the closure from the container to cause fracture of at least a portion of said bridge means.

2. A tamper-evident closure assembly for engaging and closing the open mouth of a container by rotation of the closure with respect to the container and comprising:

a skirt wall having means thereon for engaging closure retaining means on the outer surface of a container mouth;

a first annular lip projecting inwardly from the top of said skirt wall;

a second annular lip projecting inwardly from said skirt wall below said first lip;

an integral disc portion located centrally of said first lip and connected thereto by frangible bridge means;

a rigid disc liner underlying said disc portion and bonded thereto, said liner having sufficient radial extent for disposition of an outer edge portion thereof between said lips on the closure and being adapted to be bonded to the container mouth to seal the same whereby said liner and said disc portion are restrained from being rotated with the closure during removal of the closure from the container to cause fracture of at least a portion of said bridge means before said second lip on the closure strips said liner from the closure mouth.

3. A closure as described in claims 1 or 2 wherein said bridge means is at least two connecting bridges.

4. A closure as described in claim 3 wherein each bridge has a longitudinal axis which is coaxial with a radial line extending from the center axis of the closure.

5. A closure as described in claim 3 wherein each bridge has a longitudinal axis which is angularly skewed from a radial line extending from the center axis of the closure to the midpoint of each bridge.

* * * * *